US006087765A

United States Patent [19]

Coll et al.

[11] Patent Number: 6,087,765

[45] Date of Patent: Jul. 11, 2000

[54] ELECTRON EMISSIVE FILM

[75] Inventors: Bernard F. Coll, Fountain Hills; Albert Alec Talin; James E. Jaskie, both of Scottsdale, all of Ariz.

[73] Assignee: Motorola, Inc., Schaumburg, Ill.

[21] Appl. No.: 08/984,315

[22] Filed: Dec. 3, 1997

[51] Int. Cl.[7] ..... H01J 1/02; H01J 1/16; H01J 19/10; H01J 63/04

[52] U.S. Cl. ..... 313/309; 313/336; 313/346 R; 313/351; 313/495

[58] Field of Search ..... 313/306, 309, 313/310, 336, 346 R, 346 DC, 351, 495; 252/512, 518, 520; 423/446; 75/232, 245, 248; 117/104; 204/23, 298.02, 298.04, 192.38, 180.6, 192.1; 427/58, 255.6, 255.7, 375, 384, 376.1, 508, 521, 577.79, 249–250, 255.1

[56] References Cited

U.S. PATENT DOCUMENTS

| | | | |
|---|---|---|---|
| 4,038,158 | 7/1977 | Bursey et al. | 204/23 |
| 4,041,346 | 8/1977 | Bursey et al. | 313/336 |
| 4,933,108 | 6/1990 | Soredale | 252/518 |
| 5,726,524 | 3/1998 | Debe | 313/346 X |
| 5,772,760 | 6/1998 | Gruen et al. | 117/104 |

OTHER PUBLICATIONS

"A Carbon Nanotube Field–Emissiion Electron Source" by Walt A. de Heer, A. Chatelain, D. Ugarte; *Science,* vol. 270, Nov. 17, 1995, pp. 1179–1180.

"Unraveling Nanotubes: Field Emission from an Atomic Wire" by A.G. Rinzler, et al; *Science,* vol. 269, Sep. 15, 1995, pp. 1550–1553.

*Primary Examiner*—Nimeshkumar D. Patel
*Assistant Examiner*—Mack Haynes
*Attorney, Agent, or Firm*—Jasper W. Dockrey; Kevin D. Wills

[57] ABSTRACT

An electron-emissive film (170, 730) is made from graphite and has a surface defining a plurality of emissive clusters (100), which are uniformly distributed over the surface. Each of the emissive clusters (100) has dendrites (110) extending radially from a central point (120). Each of the dendrites (110) has a ridge (130), which has a radius of curvature of less than 10 nm. The graphene sheets (160) that form the dendrites (110) have a (002) lattice spacing within a range of 0.342–0.350 nanometers.

17 Claims, 5 Drawing Sheets

170

170

170

ELECTRON EMISSIVE FILM

RELATED APPLICATION

Related subject matter is disclosed in patent application Ser. No. 08/720,512, filed Sep. 30, 1996, entitled "Electron Emissive Film and Method", which is hereby incorporated by reference.

FIELD OF THE INVENTION

The present invention pertains to the area of electron-emissive films and, more particularly, to an electron-emissive carbon film for use in field emission devices.

BACKGROUND OF THE INVENTION

It is known in the art to use carbon films as electron sources in field emission devices. Electron-emissive films can provide higher emission density (electron current per unit area) than prior art Spindt tips. However, prior art carbon films suffer from several disadvantages. For example, the uniformity of the emission current across the film is typically poor and not reproducible.

It is known in the art to produce field emitted electrons from films having nanotubes. For example, Heer, et al. describe a method for forming a film of nanotubes oriented perpendicular to the plane of the film ("A Carbon Nanotube Field-Emission Electron Source", *Science,* Volume 270, Nov. 17, 1995, pp. 1179–1180.) The method of Heer, et al. includes first producing a macroscopic bundle of carbon, which is then purified. This prior art method further includes a step for separating the nanotubes to achieve a narrow size distribution. The narrow size distribution is preferred because the electrical properties of the nanotubes are highly dependent on their length and diameter. Then, a step is included for orienting the nanotubes perpendicularly with respect to the surface of the film. The film described by Heer, et al. further includes a polytetrafluoro-ethylene substrate, in which the nanotubes are anchored.

Accordingly, there exists a need for an improved electron-emissive film, which exhibits uniform electron emission, has low electric field requirements, and has simpler fabrication requirements than those of prior art electron-emissive films.

Figure 1:
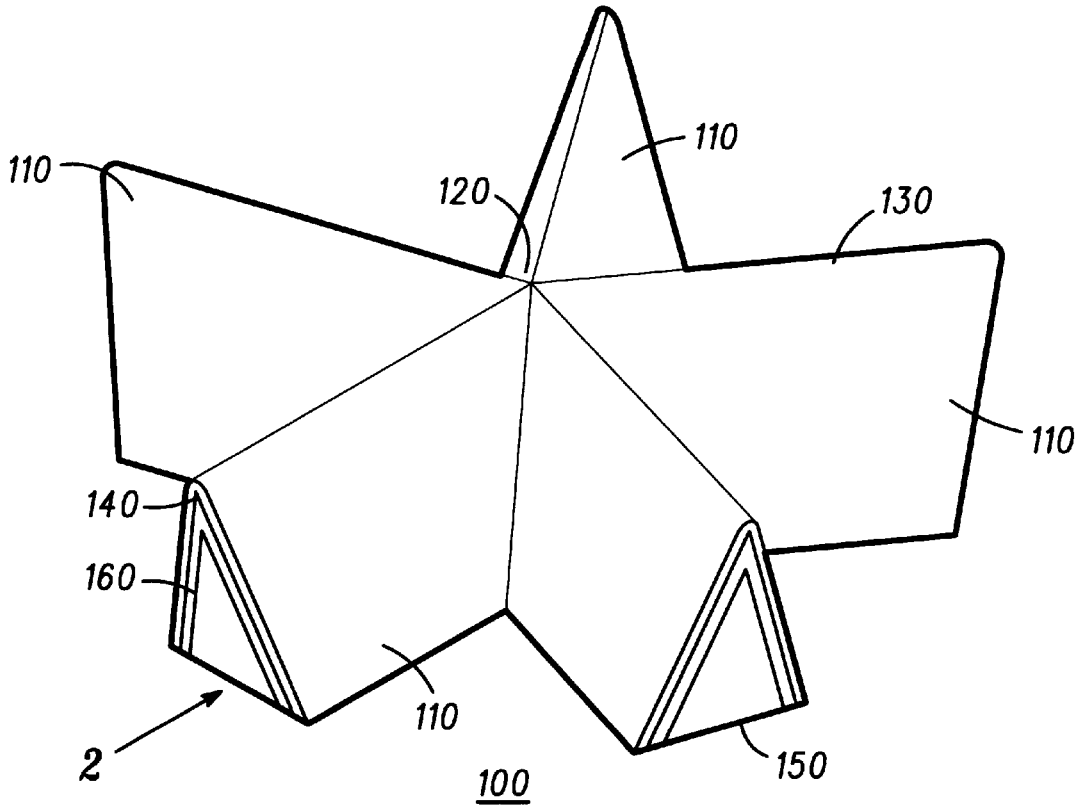
FIG.1 is a schematic representation of an electron-emissive film in accordance with the invention.

It will be appreciated that for simplicity and clarity of illustration, elements shown in the FIGURES have not necessarily been drawn to scale. For example, the dimensions of some of the elements are exaggerated relative to each other. Further, where considered appropriate, reference numerals have been repeated among the FIGURES to indicate corresponding elements.

DESCRIPTION

The invention is for an electron-emissive film having a surface that includes a generally uniform distribution of emissive clusters. Each of the emissive clusters is generally star-shaped and has dendritic platelets or dendrites, which extend generally radially from a central point. Each dendrite has a ridge, which has a radius of curvature within a range of 1–10 nm. In the preferred embodiment, each dendrite is made from graphene sheets that extend outwardly from the plane of the film and taper to form the ridge. The electron-emissive film of the invention provides uniform electron emission, has low electric field requirements, and can be fabricated in one deposition step. The electron-emissive film of the invention also exhibits electron emission over a narrow range of average electric field strengths. Because the activation and deactivation of electron emission requires switching over a narrow range of electric field strengths, a field emission device utilizing the electron-emissive film of the invention has power consumption requirements and driver costs that are lower than the prior art.

FIG. 1 is a schematic representation of an emissive cluster 100 of an electron-emissive film in accordance with the invention. The electron-emissive film of the invention has a uniform distribution of emissive clusters, such as emissive cluster 100. The surface morphology of the electron-emissive film of the invention is largely defined by these emissive clusters. It is believed that this surface morphology enhances the electric field strength at the surface of the electron-emissive film. The enhanced electric field strength results in enhanced electron emission.

As illustrated in FIG. 1, emissive cluster 100 is generally star-shaped and has a plurality of dendrites or dendritic platelets 110, each of which extends generally radially from a central point 120. It is desired to be understood that the configuration of FIG. 1 is representative. The exact number and configuration of the dendrites is not limited to what is shown in FIG. 1.

Each dendrite 110 has a narrow end 140 and a broad end 150. At narrow end 140, each dendrite 110 has a ridge 130, which extends along the length of dendrite 110. The length of dendrite 110 is preferably within a range of 50–400 nm. Most preferably, the length of dendrite 110 is about 200 nm. Ridge 130 has a radius of curvature, which is less than 10 nm, preferably less than 2 nm. It is believed that the small radius of curvature at ridge 130 results in electric field enhancement at the surface of the film, which enhances electron emission for a given applied or average electric field strength. In general, dendrites 110 are oriented to cause electric field enhancement at dendrites 110.

Figure 2:
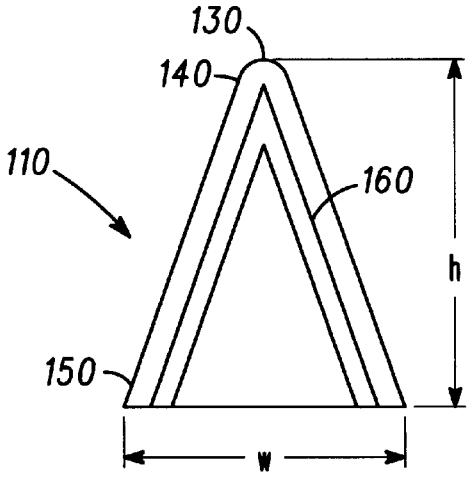
FIG.2 is a view of the electron-emissive film of FIG. 1, taken along the section line 2—2.

FIG. 2 is a view of the electron-emissive film of FIG. 1, taken along the section lines 2—2. As illustrated in FIG. 2, each of dendrites 110 has a height, h, which is equal to the distance between broad end 150 and narrow end 140. The height, h, is preferably about 100 nm. Each of dendrites 110 extends from broad end 150 to narrow end 140 in a direction away from the plane of the electron-emissive film. This configuration results in electrons being emitted in a direction away from the plane of the electron-emissive film. Further illustrated in FIG. 2 is a width, w, of dendrite 110 at broad end 150. The width, w, is equal to about 7 m.

In the preferred embodiment of the invention, the electron-emissive film is made from carbon. The carbon film of the preferred embodiment has a composite microstructure. The overall composition of the carbon film is about 80% graphitic nanocrystallites and about 20% amorphous carbon.

The preferred embodiment further has a plurality of graphene sheets 160, which are shown in FIGS. 1 and 2. Graphene sheets 160 have a (002) lattice spacing within a range of 0.342–0.350 nanometers. Graphene sheets 160 extend from broad end 150 to narrow end 140 to define dendrite 110.

Figure 3:
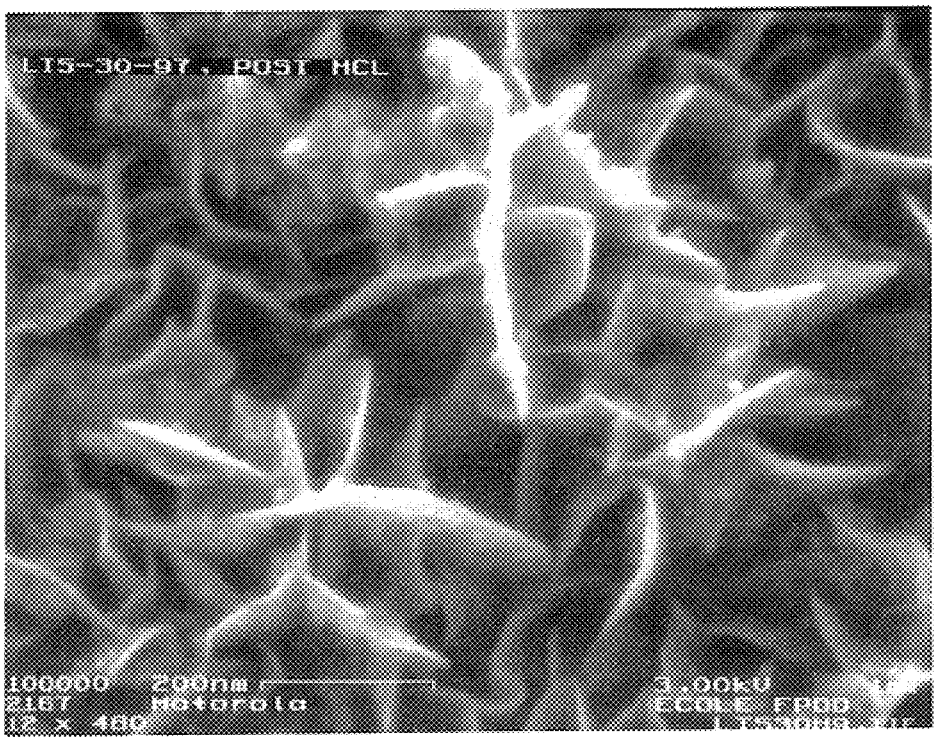
FIGS. 3 and 4 are scanning electron micrographs (SEMS) of an electron-emissive film in accordance with the invention.
Figure 4:
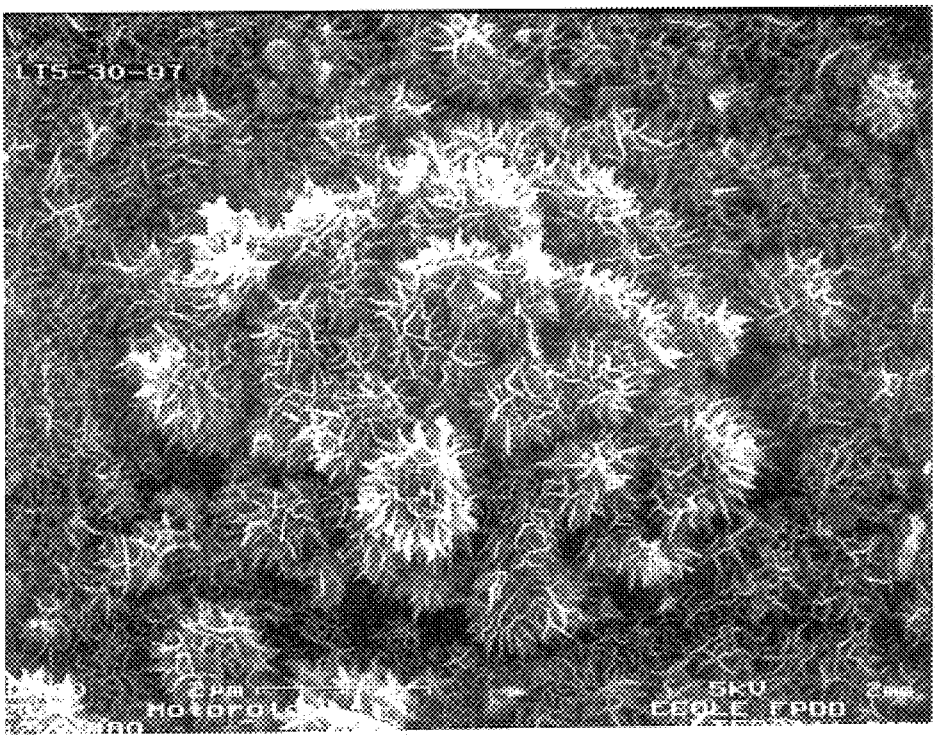
Figure 5:
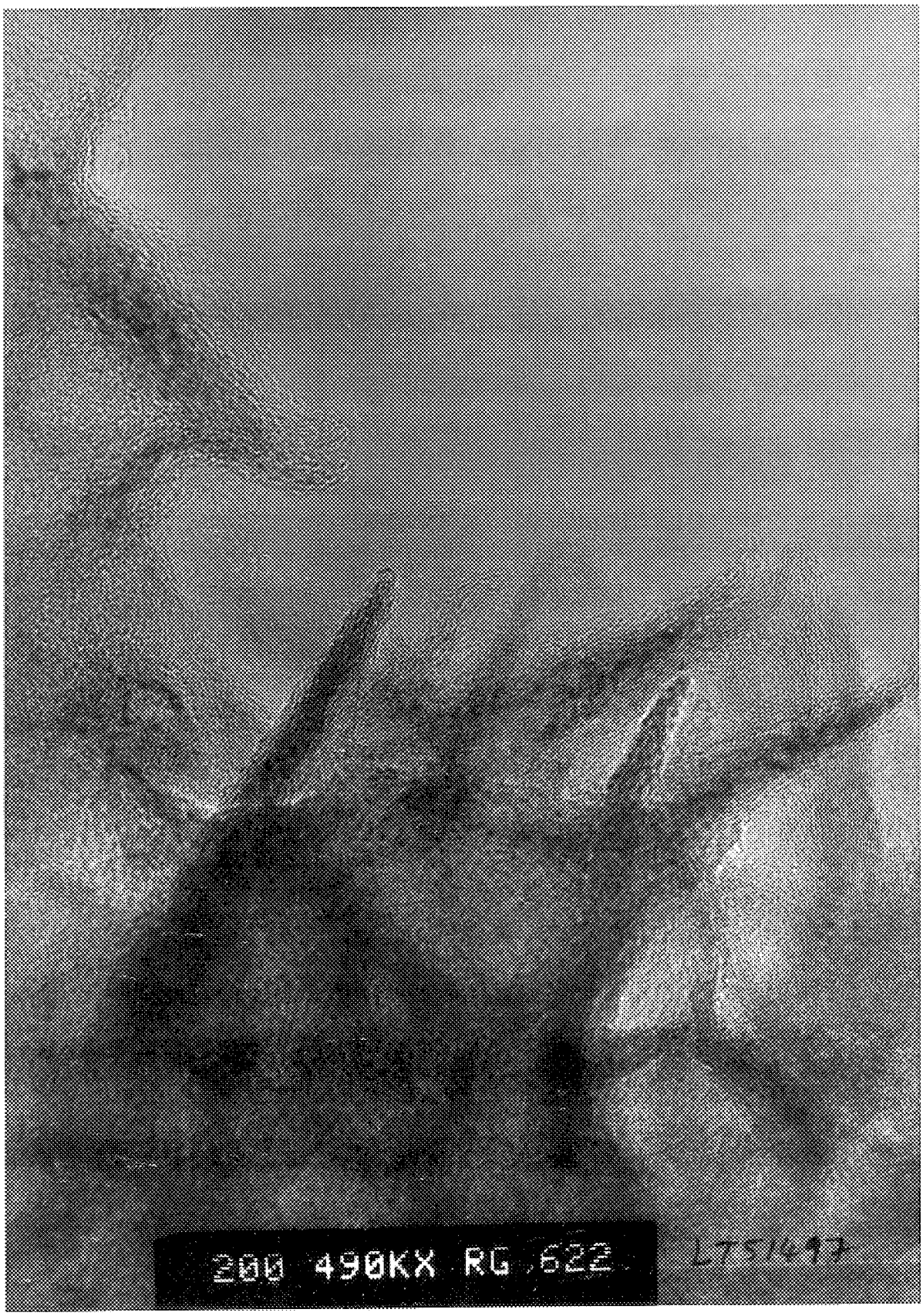
FIG. 5 is a transmission electron micrograph (TEM) of an electron-emissive film in accordance with the invention.

FIGS. 3 and 4 are scanning electron micrographs (SEMs) of an electron-emissive film 170 in accordance with the invention. FIG. 5 is a transmission electron micrograph (TEM) of electron-emissive film 170. Electron-emissive film 170 of FIGS. 3–5 is the preferred embodiment of the invention. FIGS. 3–5 illustrate the surface morphology of the preferred embodiment of an electron-emissive film in accordance with the invention. This surface morphology includes emissive clusters, such as described with reference to FIGS. 1 and 2.

The SEMs of FIGS. 3 and 4 were generated using a scanning electron microscope produced by the Leo Company of Germany, model number Leo600. The measurement conditions used to generate the SEM of FIG. 3 were a microscope voltage of 3.00 kilovolts and a working distance between the film and the electron gun of 2 millimeters. The measurement conditions used to generate the SEM of FIG. 4 were a microscope voltage of 5 kilovolts and a working distance between the film and the electron gun of 2 millimeters.

The TEM of FIG. 5 was generated using a high resolution transmission electron microscope. The measurement conditions used to generate the TEM of FIG. 5 included an electron energy of 200 kiloelectronvolts and a maximum spatial resolution of 1.8 angstroms.

Figure 6:
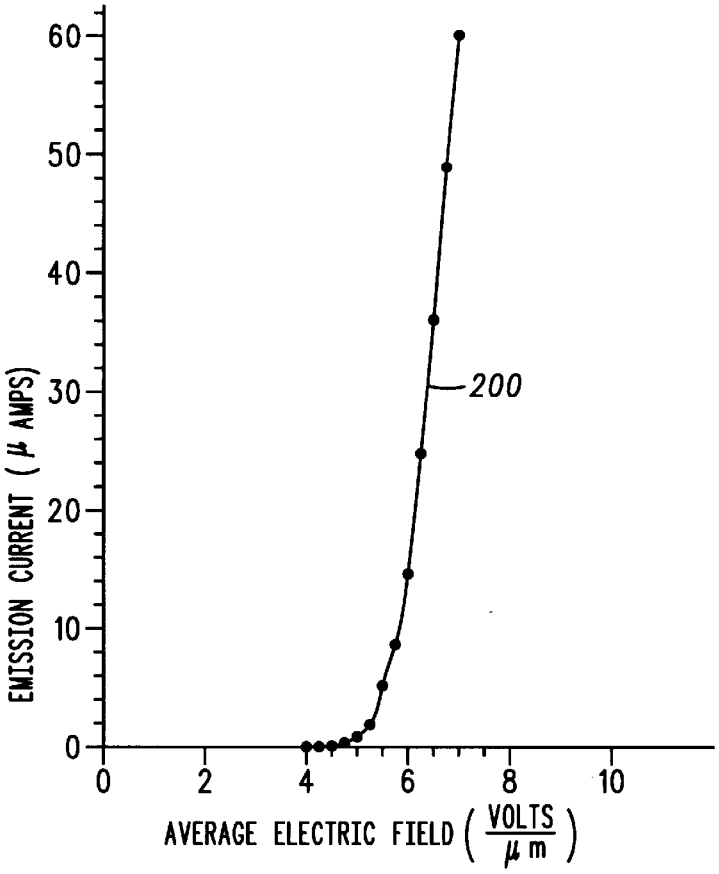
FIG. 6 is a graphical representation of emission current versus average electric field for an electron-emissive film in accordance with the invention.

FIG. 6 is a graphical representation 200 of emission current versus average electric field for electron-emissive film 170, which is shown in FIGS. 3–5. As illustrated in FIG. 6, the range of average electric fields, over which electron-emissive film 170 becomes emissive, is narrow. In the particular example of FIG. 6, the emissive range is about 4–7 V/$\mu$m. Because the activation and deactivation of electron emission requires switching over a narrow range of electric field strengths, a field emission device utilizing the electron-emissive film of the invention has power consumption requirements and driver costs that are lower than those of the prior art.

The apparatus employed to generate the emission current response of FIG. 6 included a silicon substrate, upon which was formed electron-emissive film 170. Electron-emissive film 170 was deposited as a blanket film. After electron-emissive film 170 was formed on the silicon substrate, a current meter (a pico-ammeter) was connected to electron-emissive film 170. An anode was positioned parallel to electron-emissive film 170. The anode was made from a plate of glass, upon which was deposited a patterned layer of indium tin oxide (ITO). A phosphor made from zinc oxide was electro-deposited onto the patterned ITO. The distance between the anode and electron-emissive film 170 was 0.200 mm. A voltage source was connected to the anode. The pressure within the apparatus was about $10^{-6}$ Torr.

The data points of the emission current response of FIG. 6 were generated as follows. First, a potential of zero Volts was applied to the anode, and the emission current was measure using the pico-ammeter connected to the cathode. Then, the potential at the anode was increased by +50 Volts, and the current was again measured at the cathode. The potential at the anode continued to be increased by +50 Volt increments, until a voltage of 1400 Volts was reached. At each voltage increment, the emission current was measured at the cathode. The potential at electron-emissive film 170 was maintained at zero Volts for all measurements. The average electric field was given by the ratio of: (1) the difference between the potentials at electron-emissive film 170 and the anode and (2) the distance between electron-emissive film 170 and the anode. The emission area of electron-emissive film 170 was equal to the portion of the total area of electron-emissive film 170, from which the measured current was extracted. The emission area was defined as being equal to the area of overlap of electron-emissive film 170 with the opposing anode area. In the particular example of FIG. 6, the emission area, as defined by the overlap area, was equal to 0.45 $cm^2$.

Electron-emissive film 170 also exhibited an emission site density of greater than $1\times10^6$ sites/$cm^2$ at an average electric field of 20 V/$\mu$m. The method employed for measuring emission site density is described in "Electron Field Emission from Amorphous Tetrahedrally Bonded Carbon Films" by A. A. Talin and T. E. Felter, *J. Vac. Sci. Technol.* A 14(3), May/June 1996, pp. 1719–1722, which is hereby incorporated by reference. The resolution of this technique is determined by the distance between a probe and the substrate and by the radius of the probe. The spatial resolution of the configuration employed was about 1 $\mu$m per site. Measurements were made which revealed a minimum emission site density of $1\times10^6$ sites/$cm^2$ at an average electric field of 20 V/$\mu$m. This emission site density renders the electron-emissive film of the invention suitable for use in applications, such as field emission devices, field emission displays, and the like.

Figure 7:
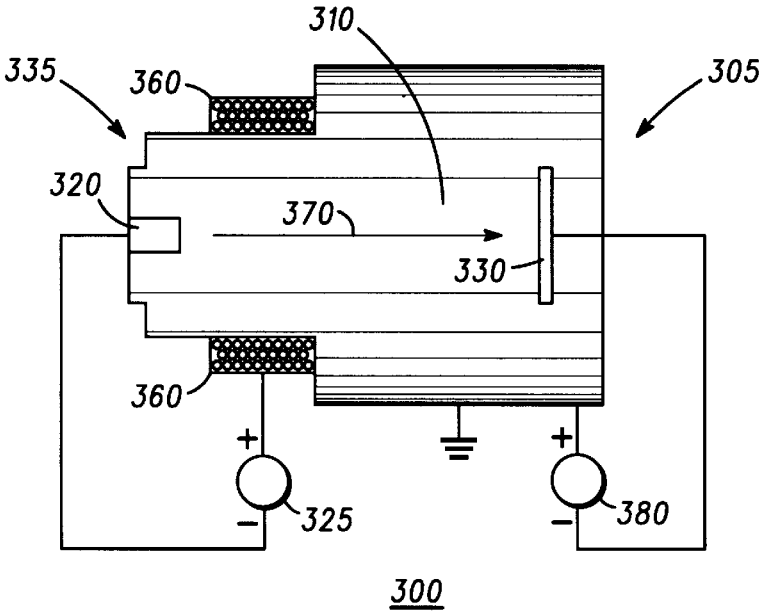
FIG. 7 is a schematic representation of a deposition apparatus useful for making an electron-emissive film in accordance with the invention.

FIG. 7 is a schematic representation of a deposition apparatus 300 useful for making an electron-emissive film in accordance with the invention. Deposition apparatus 300 is an electric arc vapor deposition system. It is emphasized that FIG. 7 is only a diagrammatic representation of such a system, which generally schematically illustrates those basic portions of an electric arc vapor deposition system that are relevant to a discussion of the present invention, and that such diagram is by no means complete in detail. For a more detailed description of electric arc vapor deposition systems and various portions thereof, one may refer to the following U.S. Pat. Nos. 3,393,179 to Sablev, et al., 4,485,759 to Brandolf, 4,448,799 to Bergman, et al., and 3,625,848 to Snaper. To the extent than such additional disclosure is necessary for an understanding of this invention, the disclosures and teachings of such patents are hereby incorporated by reference.

As shown in FIG. 7, deposition apparatus 300 includes a vacuum chamber 305, which defines an interspace region 310. A deposition substrate 330 is disposed at one end of interspace region 310. Deposition substrate 330 can be made from silicon, soda lime glass, borosilicate glass, and the like. A thin film of aluminum and/or amorphous silicon can be deposited on the surface of the substrate. At the opposite end of interspace region 310 is a deposition source 320, which is used to generate a deposition plasma 370. The deposition surface of deposition substrate 330 is located along a line-of-sight from deposition source 320. Vacuum chamber 305 further includes a duct portion 335, around which are wound copper coils to form a simple electromagnet 360. A first voltage source 325 is connected to deposition source 320. A second voltage source 380 is connected to deposition substrate 330.

First voltage source 325 is used to form an electric arc at deposition source 320. The electric arc operates on deposition source 320 to vaporize it and form deposition plasma 370. Deposition source 320 is electrically biased to serve as a cathode. An arc-initiating trigger element (not shown) is positioned proximate to deposition source 320 and is positively biased with respect to deposition source 320, so that it serves as an anode. The trigger element is momentarily allowed to engage the surface of deposition source 320, establishing a current flow path through the trigger and deposition source 320. As the trigger element is removed from engagement with deposition source 320, an electrical arc is struck, which is thereafter maintained between the electrodes. Homogeneity of the deposited film is improved by controlling the movement of the arc over the surface of deposition source 320 by applying a magnetic field with electromagnet 360.

Electron-emissive film 170 of FIGS. 3–5 was formed using deposition apparatus 300. A hydrogen carrier gas was introduced into interspace region 310 to provide a pressure within interspace region 310 of about 1 Torr. Deposition substrate 330 was a silicon wafer. Deposition source 320 was a piece of high-purity, nuclear-grade graphite having a purity within a range of 99.999–100 mass per cent graphite. The distance between deposition source 320 and deposition substrate 330 was about 10 cm. The magnetic field strength at the source for electromagnet 360 was about 0.03 Tesla. The current of the electric arc was about 100 amperes. Second voltage source 380 was used to provide at deposition substrate 330 an induced DC voltage of about −100 Volts. Deposition substrate 330 was cooled using a hollow copper plate (not shown), through which water flowed, to maintain a substrate temperature that was believed to be about 100° C. This temperature is compatible with substrate materials, such as soda lime glass, which are used in the fabrication of field emission devices. Using the deposition conditions described above, a film was deposited to a thickness of about 0.15 $\mu$m.

Figure 8:
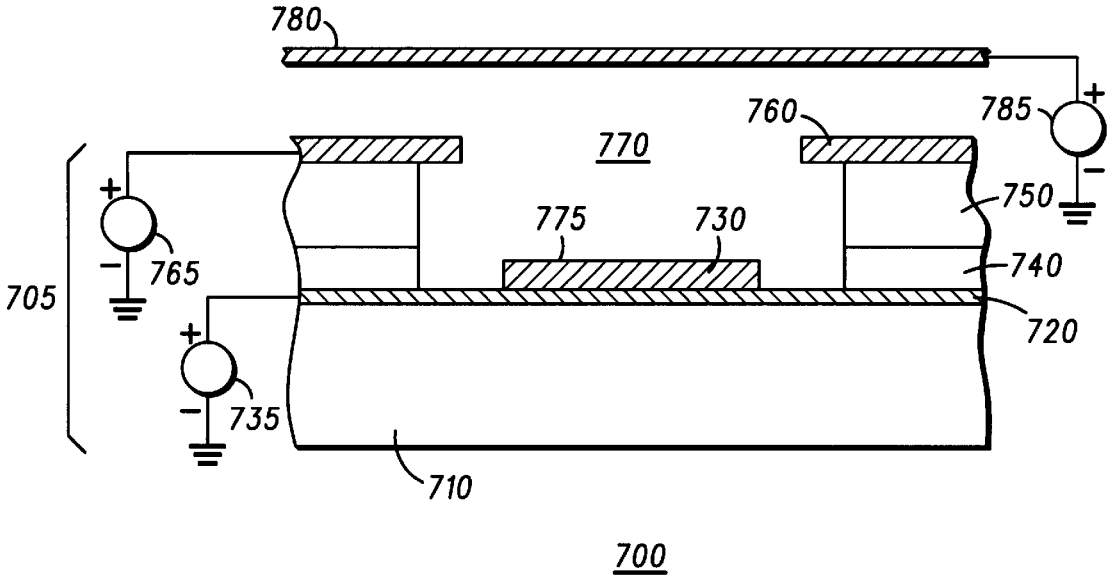
FIG. 8 is a cross-sectional view of an embodiment of a field emission device in accordance with the invention.

FIG. 8 is a cross-sectional view of an embodiment of a field emission device (FED) 700 in accordance with the invention. FED 700 includes a cathode 705 and an anode 780, which opposes cathode 705. Cathode 705 of FED 700 has an electron-emissive film 730 in accordance with the invention. It is desired to be understood that the use of the electron-emissive film of the invention is not limited to that described with reference to FIG. 8.

Cathode 705 is made by first providing a supporting substrate 710, which is made from a suitable material, such as glass, silicon, and the like. A conductive layer 720 is deposited by standard deposition techniques on supporting substrate 710. Then, a field shaper layer 740 is deposited on conductive layer 720. Field shaper layer 740 is made from a doped silicon. The dopant can be boron, and an exemplary dopant concentration is $10^{18}$ dopant species per $cm^3$. Thereafter, a dielectric layer 750 is formed on field shaper layer 740. Dielectric layer 750 can be made from silicon dioxide. A gate extraction electrode layer 760, which is made from a conductor, such as molybdenum, is deposited onto dielectric layer 750. An emitter well 770 is formed by selectively etching into layers 760, 750, 740. Emitter well 770 has a diameter of about 4 $\mu$m and a depth of about 1 $\mu$m.

The etched structure is then placed within a cathodic arc deposition apparatus, and electron-emissive film 730 is deposited, in the manner described with reference to FIG. 7. Electron-emissive film 730 is selectively deposited, as by using a mask, onto conductive layer 720 within emitter well 770. The thickness of electron emissive film 730 is preferably between 0.01 0.5 $\mu$m.

A first voltage source 735 is connected to conductive layer 720. A second voltage source 765 is connected to gate extraction electrode layer 760. A third voltage source 785 is connected to anode 780.

The operation of FED 700 includes applying suitable potentials at conductive layer 720, gate extraction electrode layer 760, and anode 780 for extracting electrons from an emissive surface 775 of electron-emissive film 730 and causing them to travel to anode 780. These potentials are applied using first, second, and third voltage sources 735, 765, 785, respectively. Field shaper layer 740 aides in shaping the electric field in the region of emissive surface 775.

In summary, the electron-emissive film of the invention has a surface that includes a uniform distribution of emissive clusters. In the preferred embodiment, the electron-emissive film is made from carbon. The electron-emissive film of the invention provides uniform electron emission, has low electric field requirements, and can be fabricated in one deposition step. The electron-emissive film of the invention also exhibits electron emission over a narrow range of average electric field strengths, which results in field emission devices having power consumption requirements and driver costs that are lower than those of the prior art.

While we have shown and described specific embodiments of the present invention, further modifications and improvements will occur to those skilled in the art. We desire it to be understood, therefore, that this invention is not limited to the particular forms shown, and we intend in the appended claims to cover all modifications that do not depart from the spirit and scope of this invention.

What is claimed is:

1. An electron-emissive film comprising a surface defining a plurality of emissive clusters uniformly distributed over the surface, wherein each of the plurality of emissive clusters is generally star-shaped, wherein each of the plurality of emissive clusters includes a plurality of dendrites extending from a central point, and wherein each of the plurality of dendrites includes a ridge having a radius of curvature that is less than 10 nm.

2. The electron-emissive film of claim 1, wherein the ridge of each of the plurality of dendrites has a radius of curvature that is less than 2 nm.

3. The electron-emissive film of claim 1, wherein the ridge of each of the plurality of dendrites is oriented in a direction away from a plane defined by the electron-emissive film.

4. The electron-emissive film of claim 1, wherein each of the plurality of dendrites has a length within a range of 50–400 nm.

5. The electron-emissive film of claim 1, wherein each of the plurality of dendrites has a height of about 100 nm.

6. The electron-emissive film of claim 1, wherein the plurality of dendrites are oriented to cause electric field enhancement at the plurality of dendrites.

7. The electron-emissive film of claim 1, wherein the plurality of dendrites are comprised of carbon.

8. The electron-emissive film of claim 7, wherein each of the plurality of dendrites is comprised of a plurality of graphene sheets having a lattice spacing within a range of 0.342–0.350 nanometers.

9. The electron-emissive film of claim 7, wherein an overall composition of the electron-emissive film comprises about 80% graphitic nanocrystallites and about 20% amorphous carbon.

10. The electron-emissive film of claim 7, further comprising an emission site density greater than $1\times10^6$ sites/$cm^2$ at an average electric field of 20 V/$\mu$m.

11. The electron-emissive film of claim 7, wherein each of the plurality of dendrites comprises a ridge having a radius of curvature within a range of 1–2 nm.

12. The electron-emissive film of claim 7, wherein each of the plurality of emissive clusters is generally star-shaped.

13. The electron-emissive film of claim 7, wherein the ridge of each of the plurality of dendrites is oriented in a direction away from a plane defined by the electron-emissive film.

14. The electron-emissive film of claim 7, wherein each of the plurality of dendrites has a length within a range of 50–400 nm.

15. The electron-emissive film of claim 7, wherein each of the plurality of dendrites has a height of about 100 nm.

16. The electron-emissive film of claim 7, wherein the plurality of dendrites are oriented to cause electric field enhancement at the plurality of dendrites.

17. A field emission device comprising:

a cathode having an electron-emissive film, the electron-emissive film having a surface defining a plurality of emissive clusters uniformly distributed over the surface, wherein each of the plurality of emissive clusters is generally star-shaped, wherein each of the plurality of emissive clusters includes a plurality of dendrites extending from a central point, and wherein each of the plurality of dendrites includes a ridge, the ridge having a radius of curvature that is less than 10 nm; and an anode disposed to receive electrons emitted from the electron-emissive film of the cathode.

* * * * *